US006227662B1

(12) United States Patent
Takata

(10) Patent No.: US 6,227,662 B1
(45) **Date of Patent: *May 8, 2001**

(54) INK JET PRINTER AND INK CONTAINER USED THEREIN

(75) Inventor: Masayuki Takata, Nagoya (JP)

(73) Assignee: Brother Kogyo Kabushiki Kaisha

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,764

(22) Filed: Aug. 19, 1998

(30) Foreign Application Priority Data

Aug. 20, 1997 (JP) ..... 9-223806
Aug. 22, 1997 (JP) ..... 9-225943

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 4,422,084 12/1983 Saito ..... 347/7
5,325,119 * 6/1994 Fong ..... 347/86
5,541,632 * 7/1996 Khodapanah et al. ..... 347/87
5,574,490 11/1996 Gragg et al. ..... 347/87
5,751,320 * 5/1998 Scheffelin et al. ..... 347/85

FOREIGN PATENT DOCUMENTS 0 678 390 A2 10/1995 (EP) .
59-204566 11/1984 (JP) .
6-183023 7/1994 (JP) .
7-52399 2/1995 (JP) .
7-205443 8/1995 (JP) .

* cited by examiner

*Primary Examiner*—N. Le
*Assistant Examiner*—Michael Nghiem
(74) *Attorney, Agent, or Firm*—Oliff & Berridge, PLC

(57) ABSTRACT

An ink container including a flexible pack which has two opposing sheet walls. A plate-shaped spring member is provided outside of the ink container, which extends over two opposing sheet walls of the flexible pack. Due to the spring member, the opposing sheet walls are biased away from each other thereby to increase the capacity of the flexible pack, causing a negative pressure in the flexible pack.

21 Claims, 10 Drawing Sheets

INK JET PRINTER AND INK CONTAINER USED THEREIN

BACKGROUND OF THE INVENTION

The present invention relates to an ink jet printer and an ink container used therein for reserving ink.

An ink jet printer has an ink container for reserving ink that is to be supplied to a printing head. FIG. 1 shows a conventional ink container 200 disclosed in Japanese Laid-Open Patent Application No. HEI 6-183023. The ink container 200 includes a cartridge case 220 and a flexible pack 210 accommodated in the cartridge case 220. The ink container 200 is connected to a printing head (not shown) via a connecting pipe 208. Since the ink container 200 is replaceable, it is necessary to prevent ink leakage out of the ink container 200 particularly when the ink container 200 is being mounted on the ink jet printer. For this purpose, a pair of plate members 201 and 202 are provided in the interior of the flexible pack 210. Further, a compression spring 205 is provided between the plate members 201 and 202, which biases the plate members 201 and 202 away from each other. Due to the spring force of the compression spring 205, the capacity of the flexible pack 210 is increased, thereby to causes a negative pressure (that is, a pressure lower than air pressure) in the flexible pack 210. Thus, the ink leakage out of the ink container 200 is prevented.

However, since the compression spring 205 and the plate members 201 and 202 are provided in the flexible pack 210, the structure of the conventional ink container 200 is complicated. Particularly, it is difficult to manufacture the flexible pack 210 accommodating the compression spring 205 and the plate members 201 and 202 by mass-production process. Additionally, it is difficult to reduce the manufacturing cost of the ink container.

SUMMARY OF THE INVENTION

It is therefore an object of the present invention to provide a simple ink container which is easy to manufacture and which prevents ink leakage.

According to an aspect of the present invention, there is provided an ink container including (1) a flexible pack having two sheet walls opposing with each other, and (2) a biasing arrangement provided to the outside of the flexible pack. The biasing arrangement biases the sheet walls away from each other thereby to increase a capacity of the flexible pack, causing a negative pressure in the flexible pack.

As constructed above, since the pressure in the flexible pack is negative, the leakage of ink out of the flexible pack is prevented. Further, since the biasing arrangement is provided to the outside of the flexible pack, the structure of the ink container is simple. Additionally, it is easy to manufacture the ink container by a mass-production process.

In a particular arrangement, the biasing arrangement includes a spring member having a plate form, which extends over two opposing sheet walls of said flexible pack. With such an arrangement, the structure of the biasing arrangement is simple.

In a particular case, the flexible pack has a certain width and a certain length. The biasing arrangement includes a U-shaped joining section located at a center of the flexible pack in a direction of the width, and fixing portions which are fixed to the opposing sheet walls of the flexible pack. The fixing portions extend in a direction of the width toward lateral sides of the flexible pack. With this, the local spring force of the spring member has a distribution in the direction with the width. In particular, the center portions of the sheet walls are strongly biased by the spring member (compared with the side portions of the sheet walls). With such an arrangement, when the amount of ink remaining in the flexible pack is small, the remaining ink gathers at the center portion of the flexible pack. Thus, ink reserved in the flexible pack can be fully used up.

Preferably, the spring member includes a band extending in a zigzag manner so that the band extends in a direction of the width and in a direction of the length. With this, the above-mentioned distribution in local spring force can be easily obtained.

According to another aspect of the present invention, there is provided an ink container including (1) a flexible pack having two sheet walls opposing with each other and an end surface, and (2) a biasing arrangement which biases the sheet walls away from each other thereby to increase the capacity of the flexible pack, causing a negative pressure in the flexible pack. When the end surface is urged in one direction, at least a part of the biasing arrangement is deformed so as to further increase the capacity of the flexible pack.

With such an arrangement, when a connecting pipe or the like is inserted in the flexible pack, the magnitude of the negative pressure in the flexible pack further increases. Thus, it is possible to prevent the ink leakage from the flexible pack. Additionally, ink remaining in a printing head can be sucked in the flexible pack through the connecting pipe.

There may be a decrease in capacity of the flexible pack since the deformation of the end surface may deforms inward when the connecting pipe pierces the end surface of the flexible pack. However, an increasing capacity of the flexible pack caused by the deformation of the biasing arrangement is larger than a decreasing capacity of the flexible pack caused by the inward deformation of the end surface. Thus, the total capacity of the flexible pack is increased.

In a particular arrangement, the biasing arrangement includes a spring member having a plate form, which extends over two opposing sheet walls of said flexible pack. Further, the spring member has curvatures so that a interval of opposing portions of the spring member is the largest at a center portion in said one direction. With this, when the connecting pipe is inserted in the flexible pack, the force can be converted to the deformation (buckling) of the spring member. It is preferable that opposing portions of the spring member deform away from each other when the spring member is urged in said one direction.

In one preferred embodiment, the ink container further includes a connecting pipe which connects the flexible pipe and a printing head. The connecting pipe pierces the end surface. Further, a pierced position on the end surface is located between the two sheet walls. With this, the pushing force is easily converted to the bending of the spring member. Conveniently, the end surface is a flat surface substantially perpendicular to the two sheet walls, so that the connecting pipe can pierce end surface.

In one case, the end surface has an eye-shape. That is, an interval between the two sheet walls at the end surface is the largest at the center thereof in a direction of the width (of the sheet walls). With this, the peripheral length of the end surface is relatively large. Thus, the increasing capacity of the flexible pack caused by the deformation of the biasing arrangement is larger than the decreasing capacity caused by the inward deformation of the flexible pack.

DESCRIPTION OF THE PREFERRED EMBODIMENT

The first embodiment of the present invention is described.

Figure 1:
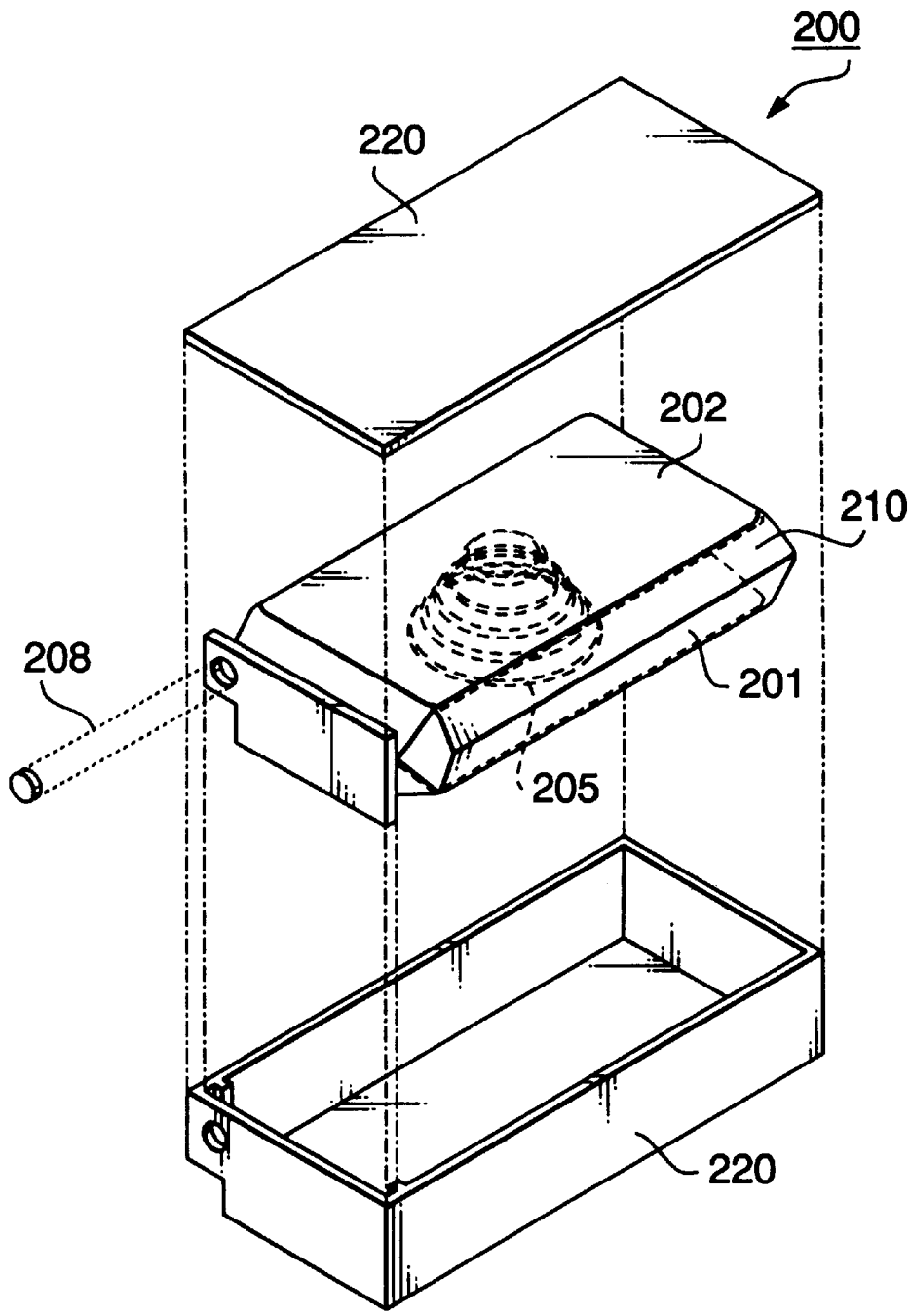
FIG. 1 PRIOR ART
FIG. 1 is an exploded perspective view showing a conventional ink container.
Figure 2:
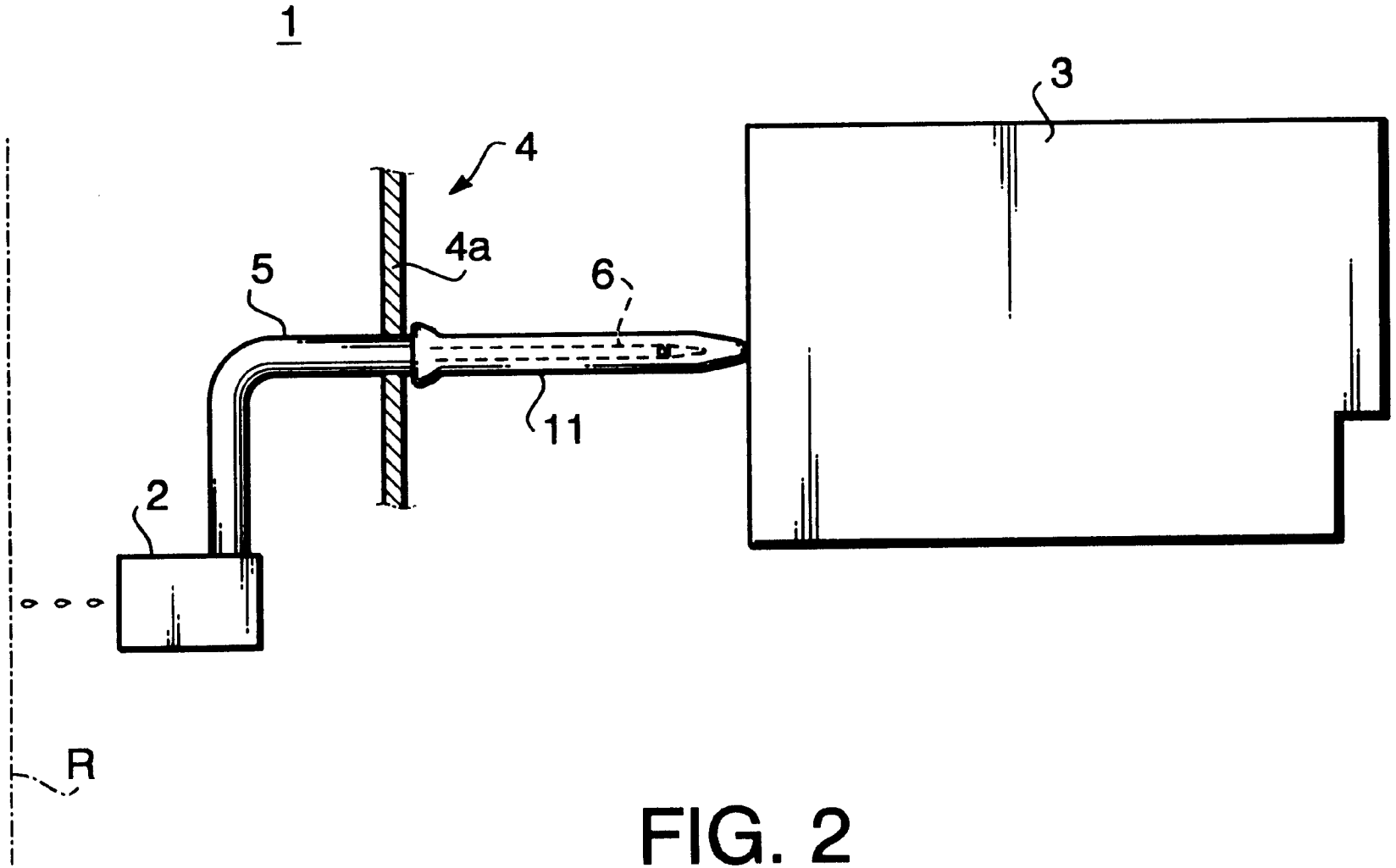
FIG. 2 is a schematic view showing a main part of an ink jet printer according to a first embodiment of the present invention.

FIG. 2 is a schematic view showing a main part of an ink jet printer according to the first embodiment. The ink jet printer 1 has a printing head 2 which emerges ink droplets to a recording media R. The printing head 2 is mounted to a carriage (not shown) that is movable in the direction of the width of the recording media R. The carriage (not shown) has a cartridge mounting portion 4 to which an ink cartridge 3 is mounted. A connecting pipe 6 is provided to the mounting portion 4, which has a sharpen tip. The connecting pipe 6 is connected to the printing head 2 via an intermediate pipe 5.

Figure 3:
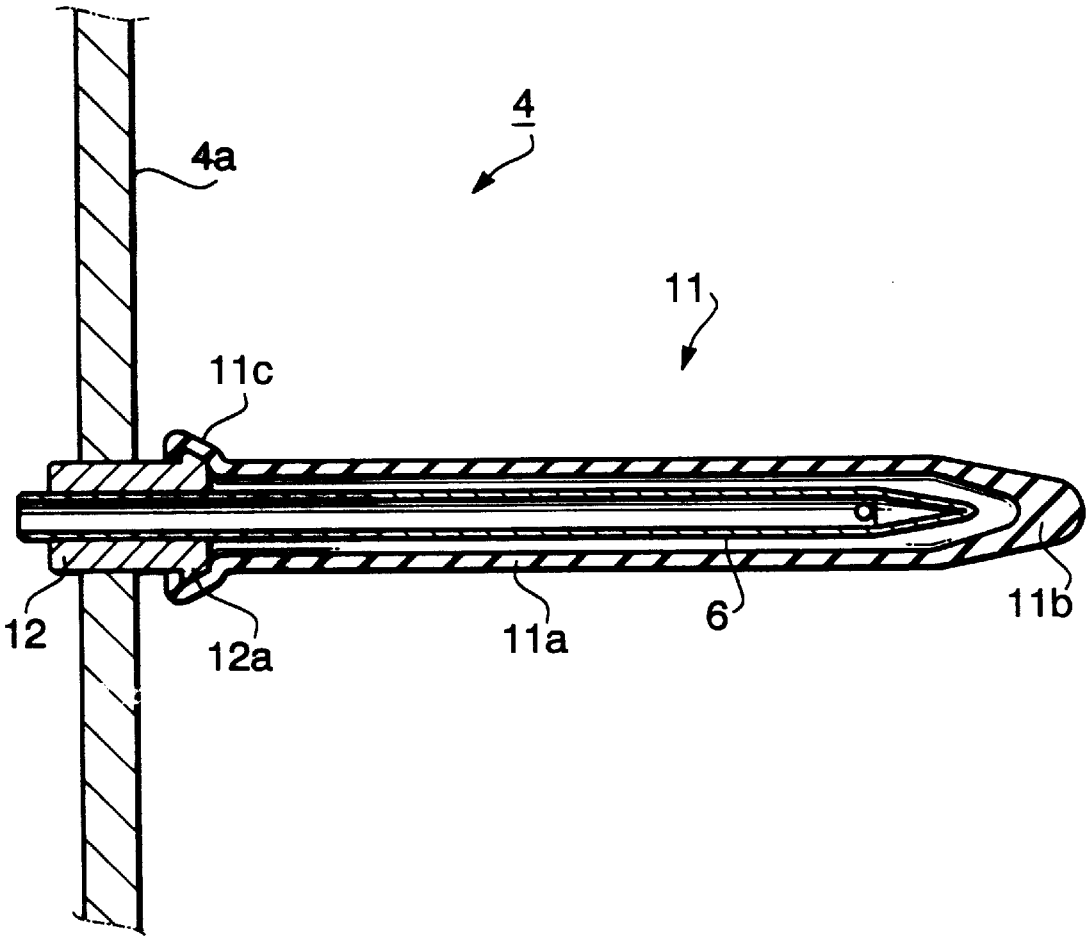
FIG. 3 is a sectional view of a connecting pipe.

FIG. 3 is an enlarged view showing the connecting pipe 6. The connecting pipe 6 is fixed to a wall 4*a* of the mounting portion 4 via a bushing 12. The connecting pipe 6 is covered by a flexible sheath 11. The flexible sheath 11 has an accordion-folded-portion 11*a* which is extensible in the longitudinal direction of the connecting pipe 6. A tail portion 11*c* of the flexible sheath 11 is hooked on a flange portion 12*a* of the bushing 12, so that the flexible sheath does not drop out of the bushing 12.

When the connecting pipe 6 is inserted into the ink cartridge 3, the connecting pipe 6 pierces and penetrates a tip 11*b* of the flexible sheath 11. The tip 11*b* of the flexible sheath 11 is thicker than the other portion of the flexible sheath 11. With this, when the connecting pipe 6 (piercing the tip 11*b* ) is removed from the tip 11*b*, a through-hole formed on the tip 11*b* is closed due to the elasticity of the tip 11*b*. It enables a user to repeatedly use the ink cartridge 3.

Figure 4:
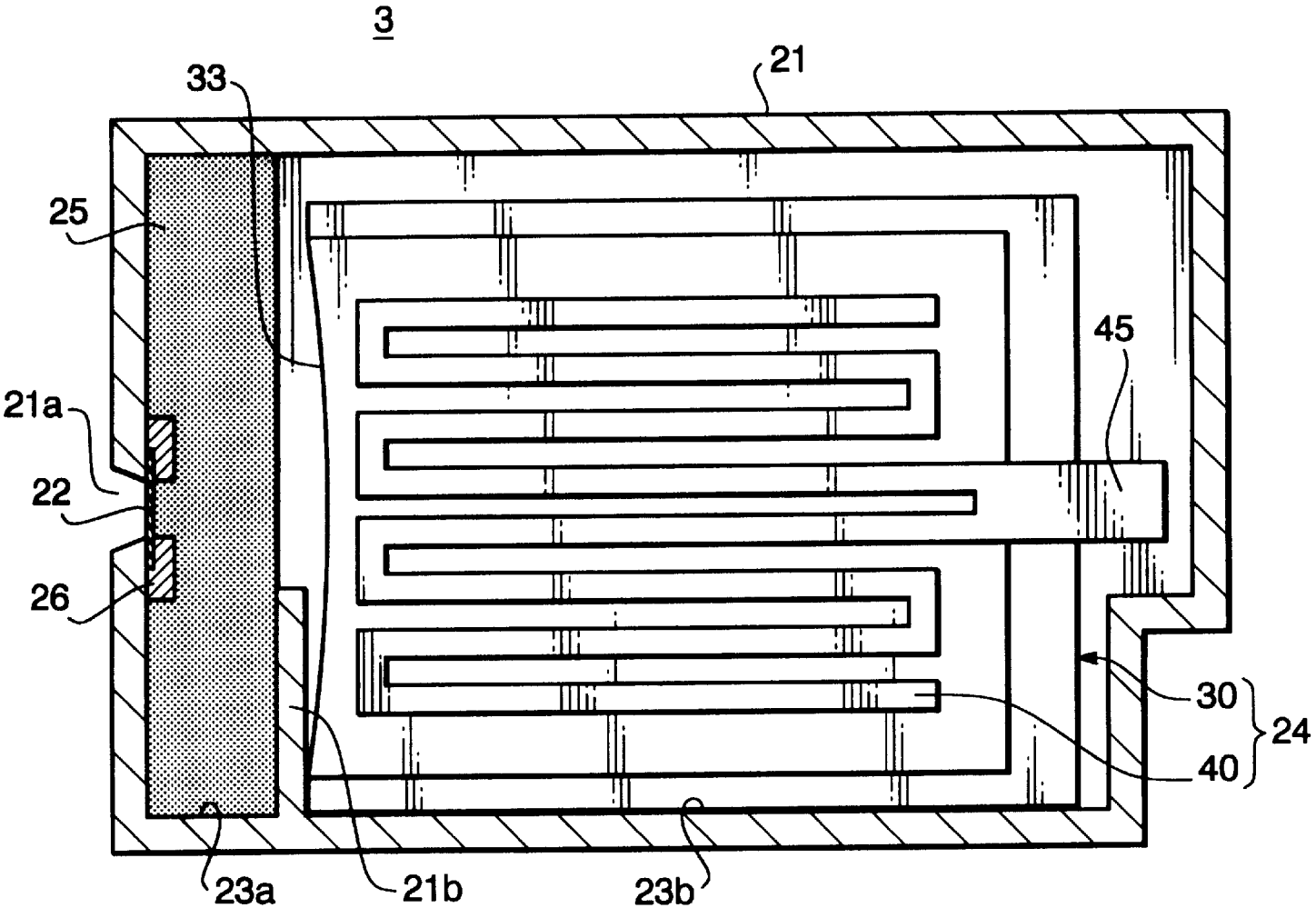
FIG. 4 is a plan view of an ink container.

FIG. 4 is a sectional view of the ink cartridge 3. The ink cartridge 3 has a cartridge case 21. The cartridge case 21 has an opening 21*a* which is tightly sealed by a seal 22 made of an elastic material such as a rubber. The seal 22 is fixed to the inner side of a wall around the opening 21. The seal 22 is opened when pierced by the connecting pipe 6 (FIG. 3).

The interior of the cartridge case 21 is divided into two regions 23*a* and 23*b* by a partition wall 21*b*. The first region 23*a* (located behind the opening 21*a*) is filled with a sponge member 25 in which ink can be impregnated. The second region 23*b* accommodates an ink container 24 detailed below.

Figure 5:
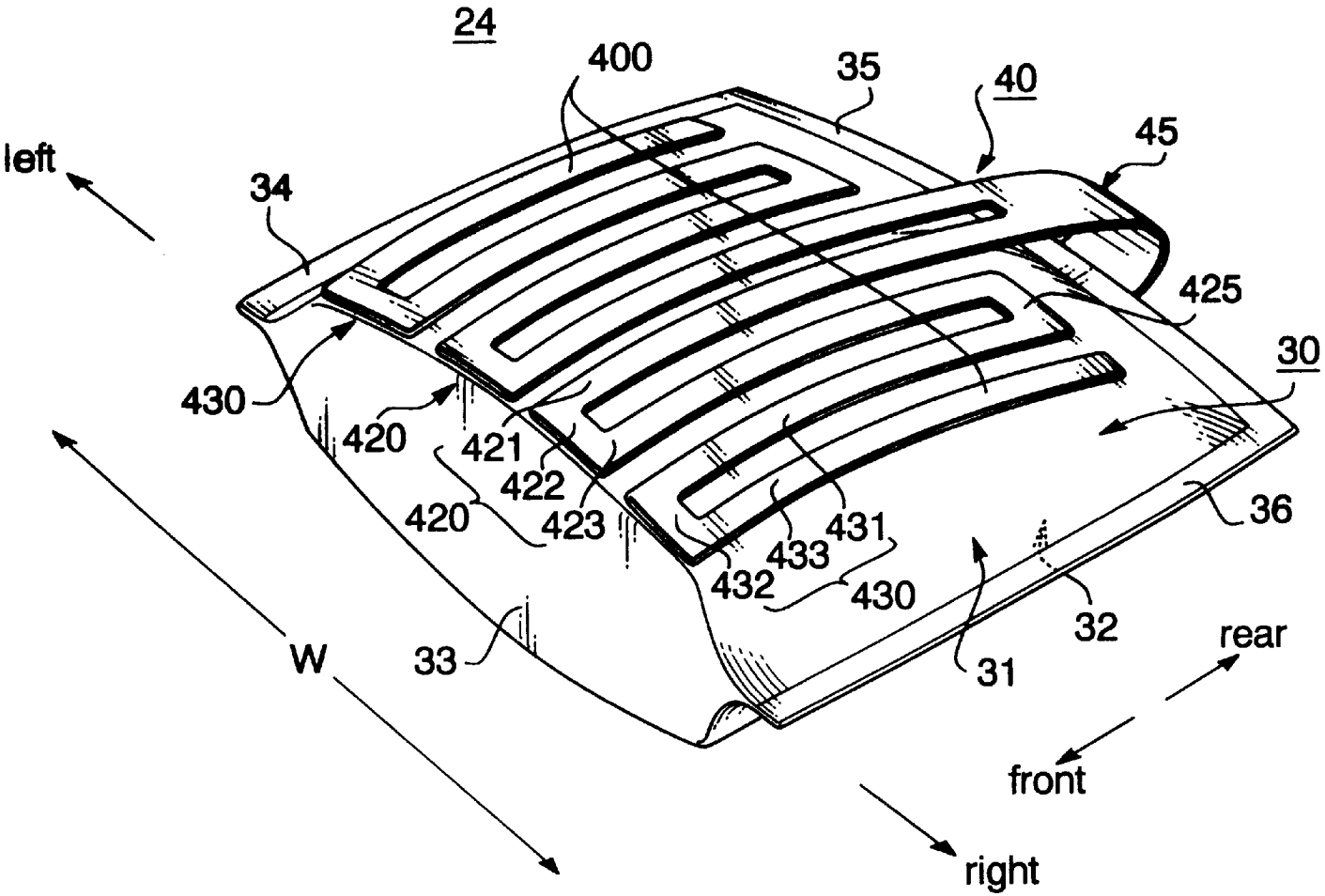
FIG. 5 is a perspective view of the ink container of FIG. 4.

FIG. 5 is a perspective view of the ink container 24. As shown in FIG. 5, the ink container 24 includes a flexible pack 30 in which ink can be reserved. The flexible pack 30 is made of a rectangular sheet. The sheet is folded (bent) into two half sheets so that one of the half sheets lies on the other. Further, three ends of one of the half sheets are attached to opposing three ends of the other by means of a heat seal.

In the description hereinafter, the half sheets of the flexible pack 30 are respectively referred to as an upper sheet wall 31 and a lower sheet walls 32 as shown in FIG. 5. The folded end is referred to as a front end 33. The (folded) front end 33 forms a plane surface that is substantially perpendicular to the upper and lower sheet walls 31 and 32. Further, three sealed ends of the flexible pack 30 are respectively referred to as a left end 34, a rear end 35, and a right end 36 as shown in FIG. 5. 5 The ink container 24 further includes a spring member 40 provided to the outer surface of the flexible pack 30. The spring member 40 has a plate form and extends over upper and lower sheet walls 31 and 32. Hereinafter, a bending section of the spring member 40 is defined as a U-shaped joining section 45. Opposing portions of the spring member 40 (fixed to the sheet walls 31 and 32) are defined as fixing portions 400 and 410. Although the lower fixing portion 410 is hidden beneath the flexible pack 30 in FIG. 5, the lower fixing portion 410 is constructed in a similar manner to the upper fixing portion 400.

The U-shaped joining section 45 is located at the center of the flexible pack 30 in the direction of the width W of the flexible pack 30. The upper fixing portion 400 has a symmetrical shape with respect to the center of the flexible pack 30 in the direction of the width W. The upper fixing portion 400 includes two inner parts 420 (close to the center of the flexible pack 30) and two outer parts 430 (close to the side ends of the flexible pack 30). The inner part 420 is π-shaped and includes (1) a first section 421 which extends frontward (in parallel to the side ends 34 and of the flexible pack 30) to the front end 33 from the U-shaped joining section 45, (2) a second section 422 which extends sideways from the front end of the first section 421, and (3) a third section 423 which extends rearward (in parallel to the side ends 34 and 36 of the flexible pack 30) to the rear end 35 from the side end of the second section 422. A connecting section 425 is provided to the rear end of the third section 423, which extends sideways. The outer part 430 is π-shaped and includes (1) a first section 431 which extends frontward to the front end 33 from the side end of the connecting section 425, (2) a second section 432 which extends sideways from the front end of the first section 431, and (3) a third section 433 which extends rearward to the rear end 35 from the side end of the section 432. The sections 421, 422, 423, 425, 431, 432 and 433 are attached to the upper sheet wall 31 of the flexible pack 30, by means of an adhesive agent or a double-sided-tape.

The lower fixing portion 410 is attached to the outer surface of the lower sheet wall 32. Since the structure of the lower fixing portion 410 is the same as the upper fixing portion 400, the detailed description thereof is omitted.

The spring member 40 is going to deform so that the fixing portions 400 and 410 move away from each other. With such an arrangement, the spring member 40 biases the sheet walls 31 and 32 of the flexible pack 30 so that the sheet walls 31 and 32 move away from each other.

As describe above, since the pressure in the flexible pack 30 is negative, the ink leakage out of the ink container 24 is prevented. Further, since the spring member 40 is provided to the outside of the flexible pack 30, the structure of the ink container 24 is simple. Additionally, it is easy to manufacture the ink container 24 by a mass-production process. Further, since the fixing portions 400 and 410 extend throughout the surfaces of the sheet walls 31 and 32, the sheet walls 31 and 32 are effectively biased.

Figure 6A:
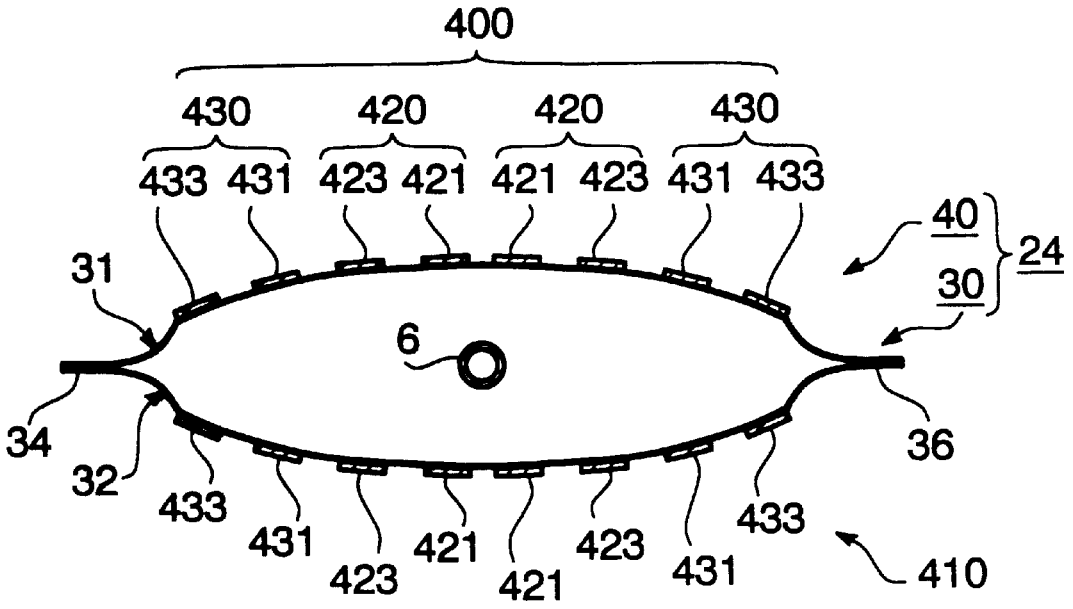
FIGS. 6A and 6B are front views of the ink container of FIG. 4.
Figure 6B:
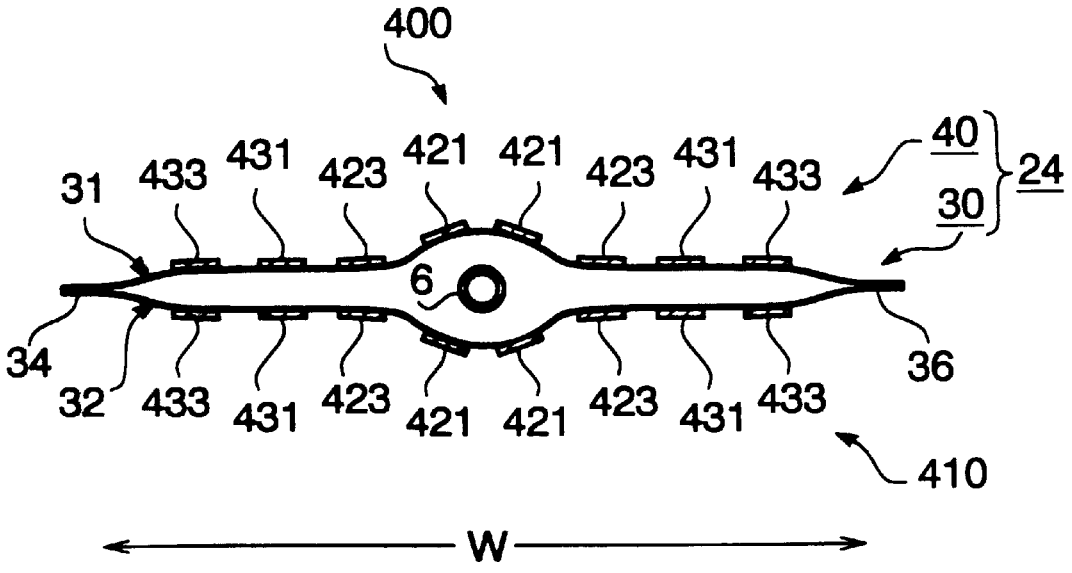

FIGS. 6A and 6B are front views of the ink container 24. The local spring force of the spring member 40 has a distribution in the direction of the width W of the flexible pack 30. Particularly, the local spring force of the spring member 40 is strongest at the center in the direction of the width W. Further, the local spring force of the spring member 40 gradually decreases, according to the distance from the center in the direction of the width W. That is, the center portions of the sheet walls 31 and 32 (in the direction of the width W) are strongly biased outward, compared with the side portions of the flexible pack 30.

When ink is fully reserved in the ink pack 30 as shown in FIG. 6A, the ink pack 30 is entirely expanded. As the amount of ink decreases as shown in FIG. 6B, the interval between fixing portions 400 and 410 at the side portions of the flexible pack 30 is rapidly contracted, compared with the center portion of the flexible pack 30. Thus, the capacity of the center portion of the flexible pack 30 is larger than the side portions of the flexible pack 30. Accordingly, the remaining ink may easily gather at the center portion of the flexible pack 30. Since the connecting pipe 6 is inserted into the center portion of the flexible pack 30, ink can be effectively drawn by the connecting pipe 6. With such an arrangement, ink reserved in the flexible pack 30 can be fully used up.

Further, since the sheet walls 31 and 32 are strongly bonded at the side ends 34 and 36 of the flexible pack 30, it promotes the tendency of the interval between the sheet walls 31 and 32 at side portions to decrease. It therefore promotes the gathering of ink at the center portion of the flexible pack 30.

Figure 7A:
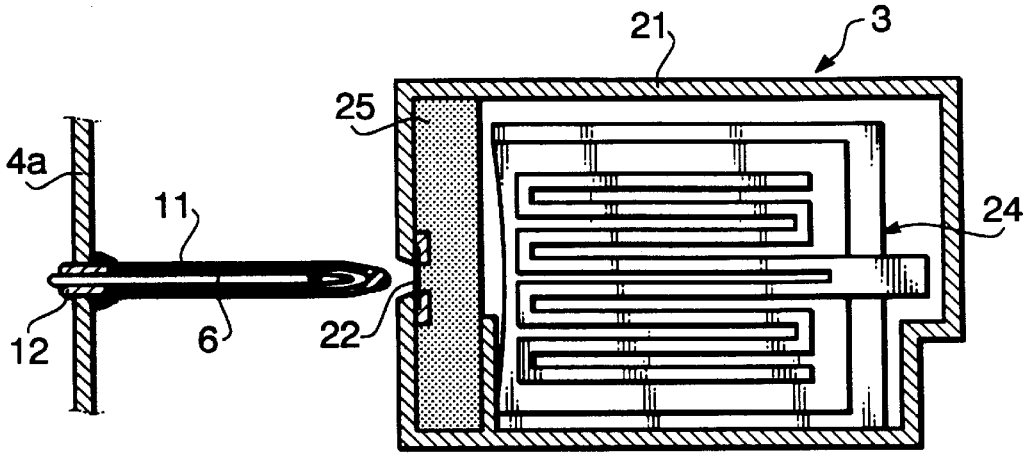
FIGS. 7A, 7B and 7C are plan views showing the connecting process of the connecting pipe and the ink container.
Figure 7B:
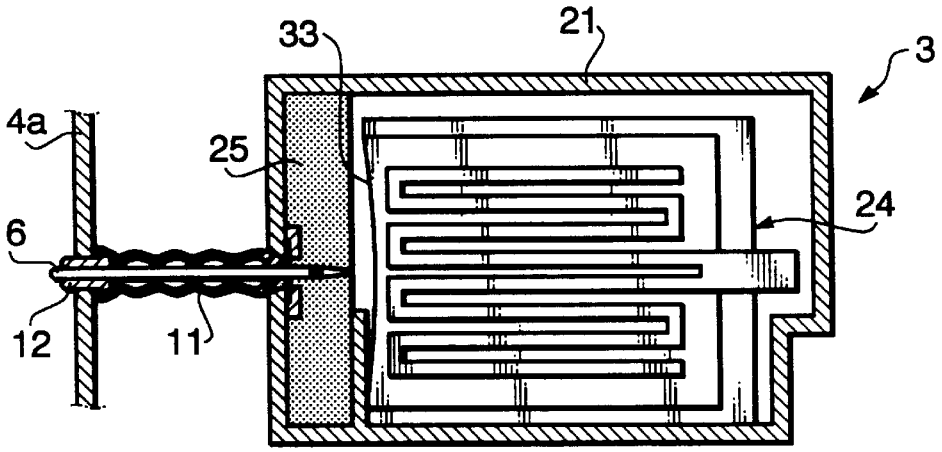

The mounting operation of the ink cartridge 3 is described with reference to FIGS. 7A, 7B and 7C. As shown in FIG. 7A, when the ink cartridge 3 is not mounted to the mounting portion 4 of the ink jet printer (not shown), the connecting pipe 6 is not inserted in the ink container 3. In this state, the connecting pipe 6 is covered by the flexible sheath 11. With this, it is prevented that the connecting pipe 6 injures a finger of a user. Further, it is prevented that the connecting pipe 6 gets dried, and that dust and debris stick on the connecting pipe 6.

When the ink cartridge 3 is mounted to the mounting portion 4, the sheath 11 is pushed by the ink container 3 so that the accordion portion 11*a* is contracted. With this, the connecting pipe 6 pierces the tip of the sheath 11*a*. Further, the connecting pipe 6 pierces the seal 22 to be inserted in the ink cartridge 3. The interior of the ink cartridge is given a negative pressure, so that ink stored in the printing head 2 (FIG. 2) is sucked in the ink cartridge 3 through the connecting pipe 6. The sucked ink is impregnated in the sponge 25 provided behind the seal 22. The printing head 2 (FIG. 2) then becomes empty.

Figure 7C:
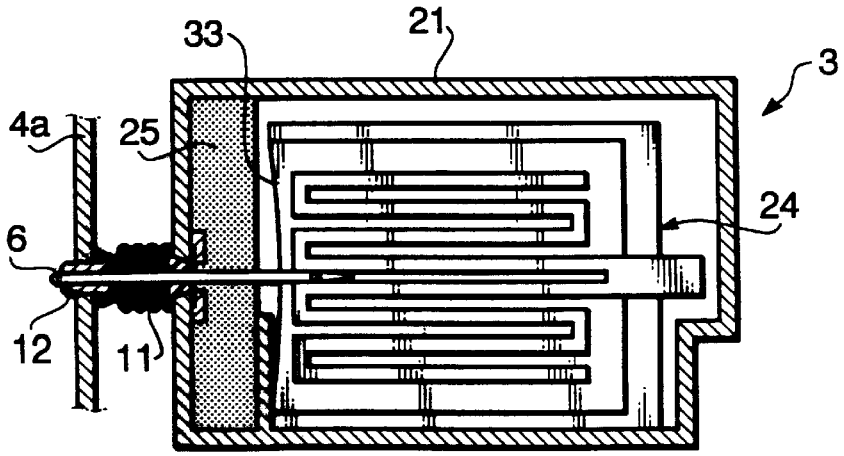

Then, as shown in FIG. 7C, the connecting pipe 6 pierces the front end 33 of the flexible pack 30, so that the tip of the connecting pipe 6 is inserted in the flexible pack 30. With this, the printing head 2 (FIG. 2) and the ink container 24 are connected so that ink can be supplied to the printing head 2 from the ink container 24.

Figure 8A:
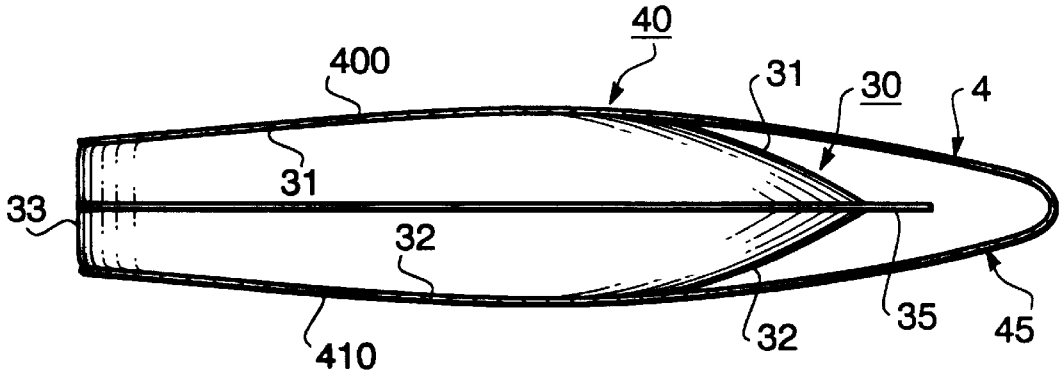
FIGS. 8A, 8B are side views of the ink container of FIG. 4
Figure 8B:
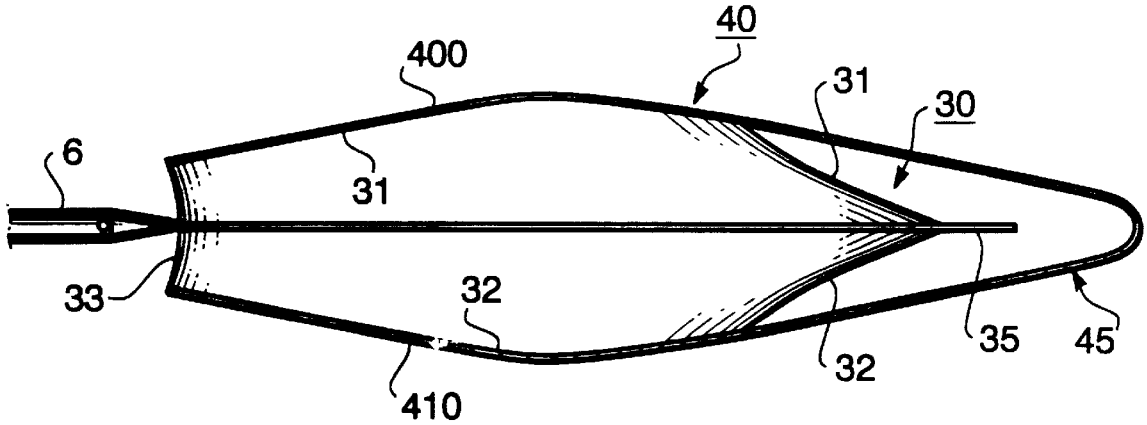
Figure 8C:
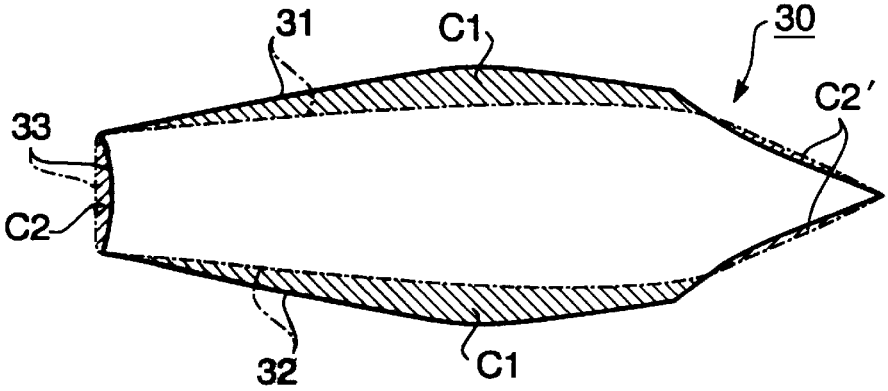
FIG. 8C is a schematic view showing a change in a capacity of the ink container.

The insertion of the connecting pipe 6 into the flexible pack 30 is detailed with reference to FIGS. 8A, 8B and 8C. The position where the connecting pipe 6 abuts the front end 30 of the flexible pack 33 is the center of the fixing portions 400 and 410. Each of the fixing portions 400 and 410 is urged in a direction substantially parallel to a plane thereof. Further, the front ends of the fixing portions 400 and 410 are minutely shifted toward each other. With this, the fixing portions 400 and 410 are buckled so that the center portions thereof in the longitudinal direction are shifted away from each other. FIG. 8C schematically shows the change in the capacity of the flexible pack 30 before and after the abutment of the connecting pipe 6. The increasing capacity Cl of the flexible pack 30 caused by the outward deformation of the upper and lower sheet walls 31 and 32 is larger than the decreasing capacity C2 caused by the inward deformation of the front end 33. This is because the interval between the fixing portions 400 and 410 is the largest at the center thereof in the longitudinal direction and gradually decreases according to the longitudinal distance from the center. Accordingly, when the connecting pipe 6 pierces the flexible pack 30, the total capacity of the flexible pack 30 increases. In FIG. 8C, the decreasing capacity C2' caused by the inward deformation of the rear part of the sheet walls 31 and 32 is small so that the capacity C2 is negligible.

As shown in FIG. 6A, the front end 33 of the flexible pack 30 has an eye-shape such that the interval between the sheet walls 31 and 32 is the largest at the center in the direction of the width W and gradually decreases according to the distance from the center in the direction of the width W. With this, the peripheral length of the front end 33 is relatively large, compared with the area of the front end 33. Thus, the increasing capacity of the flexible pack 30 caused by the deformation of the upper and lower sheet walls 31 and 32 is larger than the decreasing capacity C2 caused by the inward deformation of the front end 33.

As described above, since the total capacity of the flexible pack 30 is increased when the connecting pipe 6 pierces the flexible pack 30, it increases the magnitude of negative pressure in the ink container 24. This is advantageous in preventing the ink leakage out of the flexible pack 30 through a gap around the penetrating connecting pipe 6 and ink leakage through a nozzle of the printing head 2 (FIG. 2).

Since the portion to be pierced by the connecting pipe 6 is located between the upper and lower sheet walls 31 and 32, the front edges of the fixing portions 400 and 410 are allowed to move toward each other. With this, the pushing force of the connecting pipe 6 is easily converted to the buckling of the fixing portions 400 and 410 of the spring member 40. Additionally, since the front end 33 has a flat surface which is substantially perpendicular to the fixing portions 400 and 410, and since the connecting pipe 6 is inserted into the center of the flat surface, it is easy to let the connecting pipe 6 pierce the front end 33.

After the ink cartridge 3 is mounted to the mounting portion 4 of the ink jet printer as shown in FIG. 2, ink is introduced into the printing head 2 (through the connecting pipe 6) by a suction device provided in the printing head 2. The negative pressure in the flexible pack 30 reaches to the printing head 2, so that ink does not unintentionally drop out of the printing head 2 on starting a printing operation of the ink jet printer.

Figure 9:
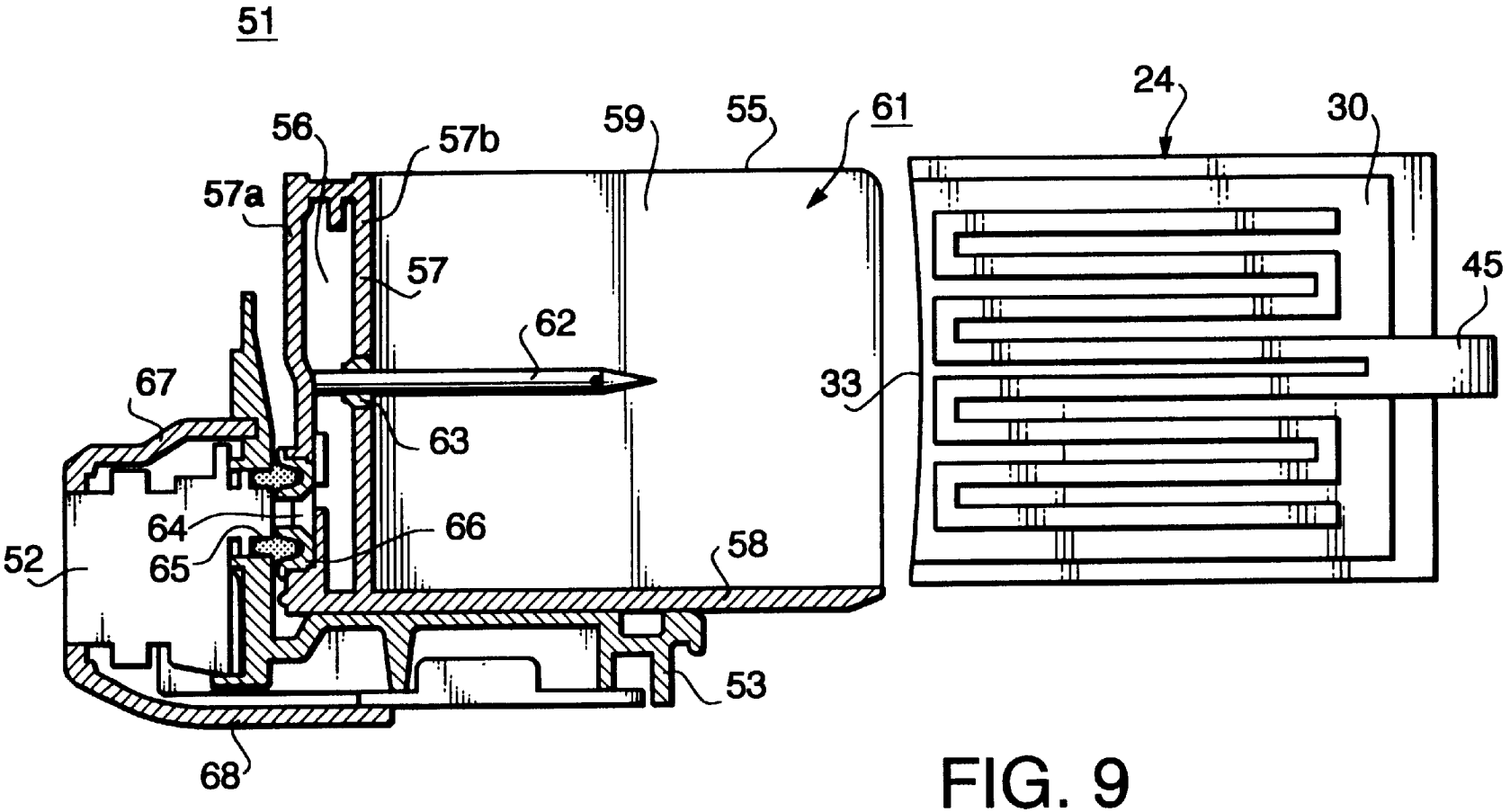
FIG. 9 is a plan view showing an ink container and a printing head according to a second embodiment of the present invention.
Figure 10:
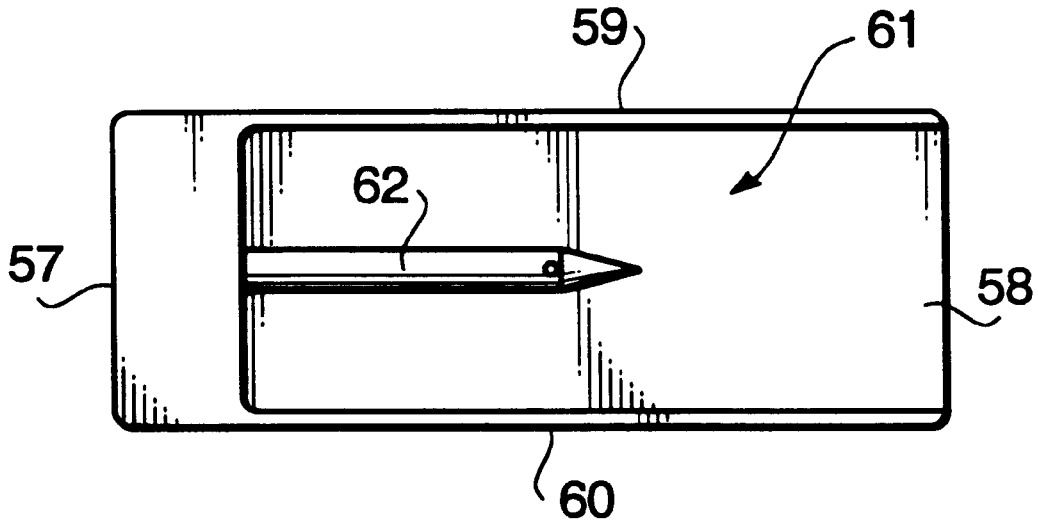
FIG. 10 is a enlarged view of a reservoir-mounting-portion of the printing head of FIG. 9.

FIG. 9 is a sectional view of a modification of the first embodiment. As shown in FIG. 9, an ink jet printer 51 has a printing head 52 and a carriage 53 that carries the printing head 52. In this modification, the ink container 24 is directly mounted to a mounting portion 55 of the carriage 53. The mounting portion 55 is made of synthetic resin, and includes a floor 58 and a double wall 57 formed on the floor 58. The double wall 57 includes first and second walls 57*a* and 57*b* and an ink chamber 56 formed between the walls 57*a* and 57*b*. Further, as shown in FIG. 10, two side walls 59 and 60 are formed at both side ends of the floor 58. The floor 58, the double wall 57 and the side walls 59 and 60 constitute a recess 61 which receives the ink container 24.

A connecting pipe 62 is provided to the double wall 57, which is arranged to pierce the ink container 24 when the ink container 24 is mounted to the recess 61. The connecting pipe 62 extends from the chamber 56 to the recess 61, supported by the second wall 57*b* via a bushing 63. An ink supply hole 64 is formed at the lower part of the chamber 56. The printing head 52 is mounted to the ink supply hole 64 via adapters 65 and 66. The printing head 52 is covered by cover members 67 and 68.

When the ink container 24 is mounted to the recess 61, the connecting pipe 62 pierces the front end 33 of the ink container 24. With this, the printing head 52 and the ink container 24 are connected with each other via the connecting pipe 62, the chamber 56 and ink supply hole 64. After the ink container 24 is mounted to the recess 61, ink is introduced into the printing head 2 (through the connecting pipe 62, the chamber 56 and ink supply hole 64) by a suction device provided in the printing head 2.

Since the pressure in the ink container 24 is negative, the leakage of ink out of the ink container 24 is prevented. Further, since the negative pressure in the flexible pack 30 reaches to the printing head 2, ink does not unintentionally drop out of the printing head 2 on starting a printing operation of the ink jet printer.

Although the structure and operation of the ink container and the ink jet printer are described herein with respect to the preferred embodiment, many modifications and changes can be made without departing from the spirit and scope of the invention.

What is claimed is:

1. An ink container comprising:

a flexible pack in which ink can be reserved, said flexible pack having two opposing sheet walls opposed to each other; and a biasing arrangement provided to an outside of said flexible pack, which extends over said two opposing sheet walls of said flexible pack, which biases said opposing sheet walls away from each other to increase a capacity of said flexible pack, causing a negative pressure in said flexible pack.

2. The ink container according to claim 1, wherein said biasing arrangement includes a spring member in a plate form, which extends over said two opposing sheet walls of said flexible pack.

3. The ink container according to claim 2, wherein said flexible pack has a certain width and a certain length, said spring member comprising:

a U-shaped joining section located at a center of said flexible pack in a direction of said width; and fixing portions fixed to said two opposing sheet walls, said fixing portions extending in a direction of said width toward lateral sides of said flexible pack.

4. The ink container according to claim 3, wherein said spring member is configured to provide a local spring force to said flexible pack that is stronger at a center of said flexible pack along said width direction than at a side along said width direction.

5. The ink container according to claim 3, said spring member comprising a band extending in a zigzag manner so that said band extends in a direction of said width and in a direction of said length.

6. The ink container according to claim 2, wherein said spring member includes opposing portions which, when said spring member is acted on by a force applied to said flexible pack in one direction substantially parallel to said opposing sheet walls, said opposing portions of said spring member deform away from each other in a direction substantially perpendicular to the one direction so as to increase a capacity of said flexible pack.

7. The ink container according to claim 6, wherein said flexible pack has an end surface formed at an end thereof in said one direction.

8. The ink container according to claim 6, wherein said spring member has a curvature so that an interval between said opposing portions of said spring member is the largest at center portions in said one direction.

9. The ink container according to claim 1, wherein said flexible pack is made by folding a rectangular sheet so that a half of said sheet lies on the other, and by attaching opposing ends of said halves.

10. An ink container comprising:

a flexible pack in which ink can be reserved, said flexible pack having two opposing sheet walls opposed to each other and defining a width and a length of said flexible pack; and a biasing arrangement provided to an outside of said flexible pack and extending substantially the entire width of said flexible pack, said biasing arrangement biasing said opposing sheet walls away from each other to increase a capacity of said flexible pack, causing a negative pressure in said flexible pack, wherein said biasing arrangement is configured to provide a local spring force to said flexible pack that is stronger at a center along said width direction of said flexible pack than at a side along said width direction.

11. An ink container comprising:

a flexible pack in which ink can be reserved, said flexible pack having two opposing sheet walls opposed to each other, said flexible pack further having an end surface; and a biasing arrangement provided to said flexible pack and extending substantially an entire width of said two opposing sheet walls of said flexible pack, said biasing arrangement biasing said opposing sheet walls away from each other to increase a capacity of said flexible pack, causing a negative pressure in said flexible pack, wherein, when said end surface is urged in one direction substantially parallel to said opposing sheet walls, at least a part of said biasing arrangement is deformed so as to further increase the capacity of said flexible pack, the increase in capacity caused by the deformation of said biasing arrangement being larger than a decreasing capacity of said flexible pack caused by inward deformation of said end surface.

12. The ink container according to claim 11, wherein said biasing arrangement includes a spring member in a plate form, which extends over said two opposing sheet walls of said flexible pack.

13. The ink container according to claim 12, wherein said spring member has curvatures so that an interval between opposing portions of said spring member is the largest at center portions in said one direction.

14. The ink container according to claim 12, wherein said spring member includes opposing portions which, when said opposing portions of said spring member are urged in said one direction, said opposing portions deform away from each other.

15. The ink container according to claim 11, further comprising a connecting pipe connecting said flexible pack and a printing head, wherein said connecting pipe pierces said end surface, a pierced position on said end surface being located between said two sheet walls.

16. The ink container according to claim 14, wherein said end surface is a flat surface which is substantially perpendicular to said two sheet walls.

17. The ink container according to claim 14, wherein said sheet wall has a certain width that is perpendicular to said one direction, and wherein said end surface has an eye-shape such that an interval between said two sheet walls at said end surface is the largest at a center thereof in a direction of said width, said interval decreasing according to a distance from said center.

18. An ink jet printer comprising:

a printing head which emerges ink droplets on a recording media;

a carrier that carries said printing head;

an ink container including a flexible pack in which ink can be reserved and a biasing arrangement, said flexible pack having two opposing sheet walls opposed to each other, said flexible pack further having an end surface, said biasing arrangement being provided to an outside of said flexible pack and extending over said two opposing sheet walls of said flexible pack and biasing said opposing sheet walls away from each other to increase a capacity of said flexible pack, causing a negative pressure in said flexible pack;

a mounting portion formed on said carriage, to which said ink container is mounted, and a connecting pipe provided with said mounting portion, which is inserted into said flexible pack, said connecting pipe connecting said flexible pack and said printing head, wherein, when said end surface is urged in one direction substantially parallel to said opposing sheet walls, at least a part of said biasing arrangement is deformed in a direction substantially perpendicular to said one direction so as to further increase the capacity of said flexible pack.

19. The ink jet printer according to claim 18, wherein said connecting pipe pierces said end surface, a pierced position being located between said two sheet walls.

20. An ink jet printer comprising:

a printing head which emerges ink droplets on a recording media;

a carriage which carries said printing head;

an ink container including a flexible pack having two opposed sheet walls opposed to each other and a biasing arrangement provided on an outside of said flexible pack that extends over said two opposing sheet walls of said flexible pack, said biasing arrangement biasing said opposed sheet walls away from each other to increase a capacity of said flexible pack, causing a negative pressure in said flexible pack;

a mounting portion formed on said carriage, to which said ink container is mounted; and a connecting pipe provided with said mounting portion, which is inserted into said flexible pack, said connecting pipe connecting said flexible pack and said printing head.

21. The ink jet printer according to claim 20, wherein said biasing arrangement includes a spring member in a plate form, which extends over said two opposing sheet walls of said flexible pack.

* * * * *